US008800742B2

(12) United States Patent
Pape et al.

(10) Patent No.: US 8,800,742 B2
(45) Date of Patent: Aug. 12, 2014

(54) AUTOMATIC CASH REGISTER SYSTEM WITH VARIABLE FIXING OF ACCEPTED DENOMINATIONS

(71) Applicant: Wincor Nixdorf International GmbH, Paderborn (DE)

(72) Inventors: Harry-Erich Pape, Berlin (DE); Horst Jung, Ratingen (DE)

(73) Assignee: Wincor Nixdorf International GmbH (DE)

( * ) Notice: Subject to any disclaimer, the term of this patent is extended or adjusted under 35 U.S.C. 154(b) by 0 days.

(21) Appl. No.: 13/653,722

(22) Filed: Oct. 17, 2012

(65) Prior Publication Data

US 2013/0092504 A1 Apr. 18, 2013

(30) Foreign Application Priority Data

Oct. 18, 2011 (DE) ..... 10 2011 054 569

(51) Int. Cl.
*G07F 7/04* (2006.01)

(52) U.S. Cl.
USPC ..... 194/206

(58) Field of Classification Search
USPC ..... 194/206, 207, 215, 216, 217; 186/35, 186/36, 37, 52, 59, 61; 209/534; 235/379; 700/215, 221, 224, 225, 226; 705/16, 705/20, 23, 400
See application file for complete search history.

(56) References Cited

U.S. PATENT DOCUMENTS

| | | | | |
|---|---|---|---|---|
| 5,183,142 | A | 2/1993 | Latchinian et al. | |
| 2004/0249501 | A1 * | 12/2004 | Hand et al. | 700/231 |
| 2007/0240966 | A1 * | 10/2007 | Tabachnik | 194/206 |

FOREIGN PATENT DOCUMENTS

| | | | |
|---|---|---|---|
| DE | 69634202 | T2 | 12/2005 |
| DE | 102007009704 | A1 | 9/2008 |
| DE | 60320643 | T2 | 9/2009 |
| WO | WO03083788 | | 9/2003 |

OTHER PUBLICATIONS

D.B. Fahrkartenautomat, "Paying at Vending Machines / Paying by Cash", Sep. 9, 2010 with English translation (2 pages).

* cited by examiner

*Primary Examiner* — Mark Beauchaine
(74) *Attorney, Agent, or Firm* — Harness, Dickey & Pierce, P.L.C.

(57) ABSTRACT

The invention relates to an automatic cash register system which comprises a detection unit for detecting goods to be paid for, a control unit which determines an amount of money due, an input unit for supplying notes of value for payment of the determined amount of money, a sensor unit for determination of the denomination of the inserted notes of value, and an output unit for dispensing change. The control unit fixes which denominations are accepted for payment of the amount of money in dependence of at least one operating parameter, and/or fixes a maximum amount in dependence of the amount of money due, wherein the control unit controls the cash register system so that in the payment of the amount of money due only notes of value or combinations of notes of value are accepted whose value does not exceed the maximum amount.

20 Claims, 3 Drawing Sheets

AUTOMATIC CASH REGISTER SYSTEM WITH VARIABLE FIXING OF ACCEPTED DENOMINATIONS

CROSS REFERENCE TO RELATED APPLICATIONS

This application claims the benefit and priority of German Patent Application No. 10 2011 054 569.7 filed Oct. 18, 2011. The entire disclosure of the above application is incorporated herein by reference.

BACKGROUND OF THE INVENTION

1. Technical Field

The invention relates to an automatic cash register system which comprises a detection unit for detecting goods to be paid for, a control unit which determines an amount of money to be paid for the detected goods, and an input unit for input of notes of value for payment of the amount of money. Further, the device includes a sensor unit for determining the denomination of the notes of value supplied for payment and an output unit for dispensing change.

2. Discussion

Automatic cash register systems are in particular employed in retail stores, for example in supermarkets. In particular, the customers themselves carry out detection of the selected goods to be paid for by passing a barcode provided on the goods by the detecting unit which is formed as a bar code scanner, so that the goods to be paid for can be scanned. Alternatively, scanning of the goods may also be carried out by a supermarket staff member. After all the goods have been scanned the automatic cash register system determines the amount due and displays this amount to the customer by means of a display unit, e.g. a monitor. Thereupon, in order to settle the amount, the customer supplies notes of value via an input unit into the automatic cash register system which, after the notes of value have been supplied, determines and dispenses the change to the customer.

Automatic cash register systems bear the problem that for payment of the amount of money only fixed denominations are accepted. In particular all denominations of one currency set are accepted, so that for example for payment of a small amount of only few euros a 500-euro banknote is accepted. As a result much change must be dispensed which in turn can lead to the necessity of supplying the automatic cash register system often with new change, which involves great expenditure of time and money.

One possibility of avoiding the above is to fixedly determine that certain denominations, for example 500-euro banknotes are generally not accepted. This bears the problem that in that case many small denominations must be supplied for paying high amounts of money. Moreover, this could annoy customers.

SUMMARY OF THE INVENTION

It is the object of the invention to specify an automatic cash register system wherein the frequency at which the automatic cash register system must be supplied with new notes of values and/or the notes of value must be removed is low.

According to a first aspect of the invention the object is solved by the measure that the control unit fixes in dependence of a current operating parameter which denominations are accepted for payment of the amount of money. Thereby it is achieved that the accepted denominations are not fixedly predetermined but can be variably set each time in dependence of the operating state of the automatic cash register system, so that the time interval within which the automatic cash register system must be supplied with new notes of value or notes of values must be removed, respectively, can be extended.

The current operating parameter is in particular the amount of money due. Here, the control unit fixes the accepted denominations in particular so that higher denominations are accepted the higher the amount due is.

In particular, a threshold value is stored in the control unit for at least one denomination. The control unit compares the amount due with the threshold value and controls the cash register system so that a note of value of the denomination is accepted only if the amount due is smaller than the threshold value.

Thereby it is avoided that for payment of relatively small amounts notes of value of high denominations are accepted.

It is particularly advantageous if for each of several denominations, preferably for all denominations of a preset currency set a respective threshold value is preset in dependence of which the control unit determines whether the respective denomination is accepted.

Further, it is advantageous if the control unit determines, for at least one preset denomination, the current stock of notes of value of this denomination in the cash register system, and if the control unit fixes of which denomination notes of value are accepted in dependence of the current stock. In this case the current stock of the cash register system is the current operating parameter in dependence of which the denominations accepted are fixed.

The control unit preferably determines for all denominations of a preset currency set the current stock of notes of value of the respective denomination in the cash register system and defines which denominations are accepted in dependence of the current stocks. In particular, threshold values are again preset with which the control unit compares the current stock. Thereby it is in particular achieved that if only relatively few notes of value of a denomination, in particular less notes of value than the preset threshold value are present, and if many notes of value of this denomination are needed for giving the change in case of payment with a high denomination, the control unit determines that this high denomination is not accepted so that not too many notes of value of the denomination in short supply must be dispensed.

Further it is advantageous if information is stored in the control unit that notes of value of at least one predetermined denomination are generally not accepted. This way, it can be easily achieved that dispensing of the change is controllable. In particular it is predetermined that notes of value of the highest denomination of the preset currency set are not accepted so that the number of the notes of value to be dispensed as change is reduced. This measure of predetermining that a denomination is generally not accepted is particularly advantageous if the cash register system is used in an environment where usually only small amounts have to be paid.

Further, it is advantageous if the control unit after input of a note of value for payment of the amount of money determines the denomination of this note of value, and if the control unit compares the denomination of the note of value with the amount of money due. If the denomination of the note of value is smaller than the amount due, the control unit determines a remaining amount which is still due. For this purpose, the control unit in particular subtracts the denomination of the note of value from the amount of money due. Depending on at least one current operating parameter the control unit subsequently fixes which denominations are accepted for payment of the remaining amount. Thus it is achieved that the accepted denominations can be adapted to a current operating state also for payment of the remaining amount, so that the availability of individual denominations and thus the intervals of emptying and supply of the automatic cash register system can be extended.

The control unit in particular fixes which denominations are accepted for payment of the remaining amount in dependence of the determined remaining amount. Here, fixing of the denomination is carried out in particular according to the same criteria and the same processes as described above for fixing of the denominations accepted for payment of the originally determined total amount. Alternatively, other criteria than those mentioned above may be used for payment of the remaining amount.

In a particularly preferred embodiment the control unit fixes in dependence of an amount of money due a maximum amount and controls the cash register system so that for payment of the amount of money due only notes of value or combinations of notes of value are accepted which do not exceed the maximum amount. Via fixing this maximum amount it is achieved that no amount is supplied by the operator of the automatic cash register system that is considerably higher than the amount of money due so that the amount of change to be given is limited by this maximum value. Thus also this maximum amount serves to increase the interval at which the automatic cash register system must be supplied with new banknotes.

A further aspect of the invention relates to an automatic cash register system comprising a detection unit for detecting goods to be paid for, a control unit which determines an amount of money due, an input unit for input of notes of value for payment of the amount of money, a sensor unit for detecting the denomination of the notes of value supplied, and an output unit for dispensing change. In dependence of the amount of money due the control unit determines a maximum amount and controls the cash register system so that only notes of value of combinations of notes values are accepted which do not exceed the maximum value.

Thereby it is achieved that the change to be maximally given is limited and that thus the availability of the individual denominations in the cash register system can be regulated. In particular, the time intervals are extended within which the automatic cash register system must be supplied with new notes of value.

It is advantageous if the control unit determines the stock of notes of values of at least one denomination and if the control unit determines the maximum amount in dependence of this stock. The control unit in particular determines the smaller a maximum amount, the lower the stock is.

Additionally or alternatively, the control unit can fix the maximum amount in dependence of the amount due by multiplying of the amount of money due by a predetermined factor. This factor in particular has a value between 1.1 and 3, preferably between 1.5 and 2. Thus it is ensured that the so-called overpayment, i.e. that a high amount of money is supplied in order to pay for a small amount, is restricted. This is in particular supposed to avoid that for example 50 euros are input for payment of only 4 euros.

In a particularly preferred embodiment of the invention a remaining amount due is determined by the control unit after input of each note of value for payment of the amount by the control unit subtracting the denomination of the supplied note of value from the amount due. Subsequently, the control unit newly determines the maximum amount in dependence of this remaining amount. Thereby it is achieved that after input of each note of value for payment of the amount of money the maximum amount is adapted to the remaining amount still due, so that when payment of the goods is made successively the maximum amount of change that can be given is limited.

Alternatively, payment of the amount of money can also be made through input of a bundle of notes of value via the input unit. In this case the control unit determines the value of the complete bundle and compares this value with the maximum amount fixed in dependence of the amount of money due.

Fixing the accepted denominations in particular means that notes of value of these accepted denominations are accepted for payment of the amount of money, while denominations other than these denominations are rejected, i.e. these notes of value are returned.

The device in particular comprises a display unit, for example a monitor, which informs the operator if a note of value is not accepted and in particular outputs information asking the operator to use a note of value of the denominations accepted for payment of the amount of money due. In particular the operator is shown via this display of which denominations notes of value are accepted for payment of the amount due.

BRIEF DESCRIPTION OF THE DRAWINGS

Further features and advantages of the invention result from the following description which in connection with the enclosed Figures explains the invention in more detail with reference to embodiments.

DESCRIPTION OF THE PREFERRED EMBODIMENTS

Figure 1:
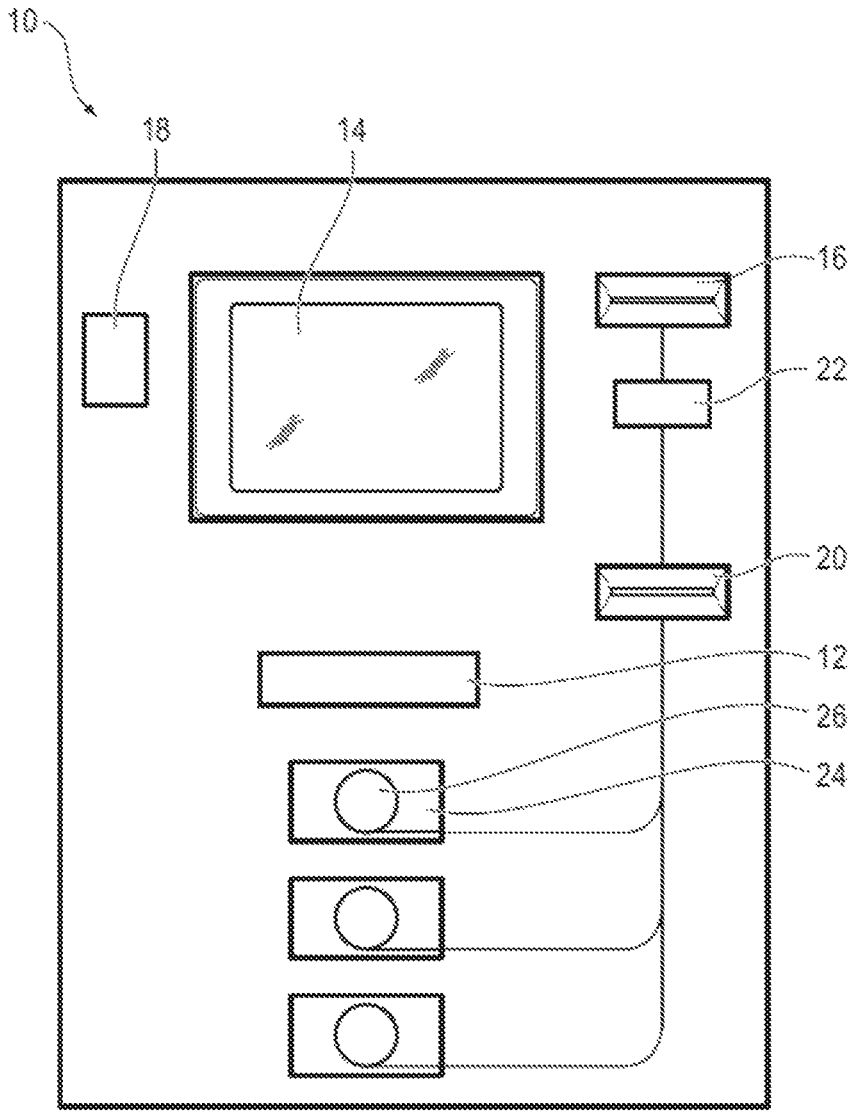
FIG. 1 is a schematic illustration of a cash register system.

In FIG. 1, a schematic illustration of an automatic cash register system 10 is shown. Automatic cash register systems 10 are in particular employed in retail stores in order to allow customers to pay for the selected goods themselves (self-checkout) without requiring a staff member for input of the goods to a manual cash register. Alternatively, the automatic cash register system 10 can be a cash register system wherein the goods are scanned by a staff member but change is given automatically.

The automatic cash register system 10 comprises a detection unit 12 by means of which the goods selected by the customer are detected. The detection unit 12 is in particular a barcode scanner by means of which the barcodes printed on the selected goods are read.

After all selected goods have been detected via the detection unit 12 the amount of money payable for the detected goods is displayed to the customer via a monitor 14 which can be in particular formed as a touchscreen display. Alternatively, after each time a further good has been detected the subtotal can already be displayed successively via the monitor 14.

Further, after detection of all goods the customer can be asked via the monitor 14 to input notes of value for payment of the amount of money due via an input unit 16. Alternatively, the customer can be offered to select between payment with cash or payment via EC card or credit card via the monitor 14. In this case the customer makes a selection in particular by touching a corresponding selection window displayed on the monitor 14 which is formed as a touch screen display.

The notes of value for payment of the amount of money due are in particular supplied separately via the input unit 16. Alternatively, the notes of value can be input simultaneously as a bundle of notes of value via the input unit 16. In this case, the notes of value are separated after supply.

After supply of a note of value via the input unit 16, the note is transported to a sensor unit 22 by means of which genuineness of the note of value is tested and the denomination is determined. A control unit 18 of the automatic cash register system 10 thereupon checks whether the value of the supplied note of value or of the supplied notes of value, respectively, is at least as high as the amount of money due and, if this is true, calculates the change to be given to the customer.

The supplied notes of value are received in storing units one of which is designated by reference number 24 by way of example. In the embodiment shown in FIG. 1 three storing units 24 are provided, while more than three storing units 24, for example seven storing units 24, or less than three storing units 24 can be provided alternatively. The storing units 24 preferable each comprise a roller storage 26 on which the notes of value are stored, received between two film ribbons and wound upon a winding drum. The notes of value which have been supplied via the input unit 16 are distributed to the storing units 24 in particular in accordance with their respective denomination. In particular, the number of storing units 24 corresponds to the number of different denominations of a predetermined currency set which is to be used for payment of the goods. Thus, homogeneous storage of the individual denominations is possible, i.e. each storing unit 24 accommodates only notes of value of a single denomination.

After the control unit 18 has calculated the change the control unit determines according to preset processes how many notes of value of which denominations are to be dispensed via an output unit 20 of the cash register system 10 in order to give this change, and controls the storing units 24 so that the corresponding number of notes of value is removed from the corresponding storing units 24 and transported to the output unit 20.

The method of paying for the selected goods, in particular the process of fixing the denomination of which notes of value are accepted will be described in more detail in connection with FIGS. 2 and 3.

In an alternative embodiment of the invention the input unit 16 and the output unit 20 can also be formed as a common unit.

For the sake of simplicity, FIG. 1 illustrates supply of cash and return of change via notes of value only. In a preferred embodiment the automatic cash register system further comprises storage containers in which coins are accommodated. Accordingly, also coins can be input for payment of the amount due and can be dispensed for giving change. For this purpose, in particular a further input unit and an output compartment for dispensing the coins are provided.

Figure 2:
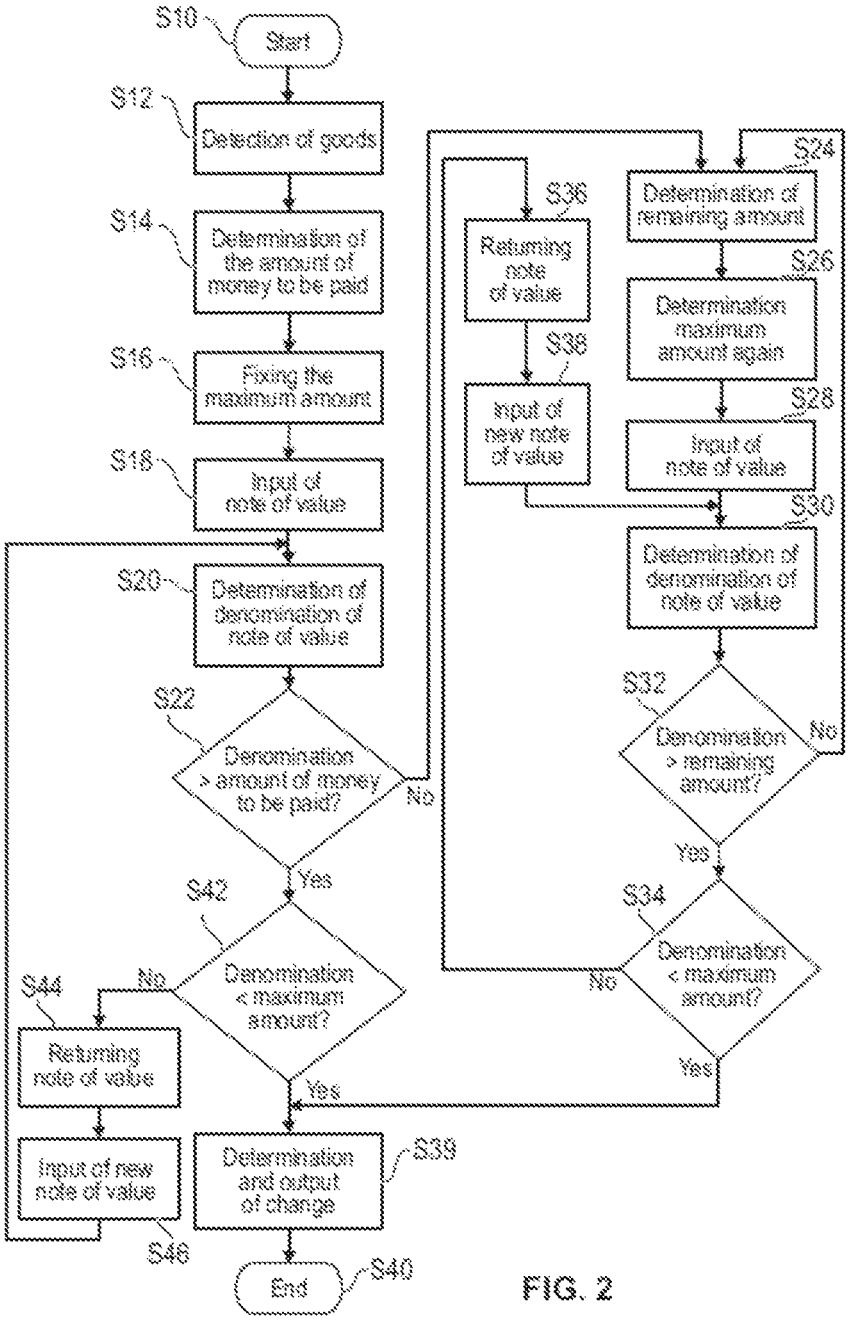
FIG. 2 is a flow chart of a process for paying for selected goods according to a first embodiment.

FIG. 2 shows a flow chart of a process for paying for the selected goods according to a first embodiment. After the process has started in step S10, the goods selected by the customer are detected by means of the detecting unit 12 and the price of each good is determined in step S12.

After all the goods the customer intends to buy have been scanned, the control unit 18 determines in step S14 an amount of money due and controls the monitor 14 to display the amount due to the customer. Further, the customer is asked via the monitor 14 to supply the amount due via the input unit 14.

Subsequently, the control unit 18 in step S16 fixes a maximum amount in dependence of the amount of money due, wherein this maximum amount defines the value which cannot be exceeded when subsequently the amount due is paid by the person operating the automatic cash register system 10 supplying the notes of value. In the following a case is described in which for payment of the amount of money only one banknote at a time is supplied via the input unit. In this case the maximum amount is the value which must not be exceeded by this supplied note of value.

If, however, payment is made by supply of a bundle of notes of value the maximum amount defines the value which must not be exceed by the total of the notes of value of this bundle.

Then, in step S18 a note of value is supplied via the input unit 16. Subsequently, in S20 the denomination of the supplied note of value is determined by means of the sensor unit 22. In step S22 the control unit 18 compares the denomination with the amount of money due. If the result of this comparison is that the denomination, and thus the value of this note of value, is smaller than the amount of money due, the control unit determines a remaining amount still due in step S24 by subtracting the denomination of the supplied note of value from the amount of money due.

Subsequently, the control unit 18 in step S26 fixes a new maximum value which the note of value next supplied by the customer via the input unit 16 for payment of the remaining amount must not exceed.

In step S28 a further note of value is supplied by the person operating the automatic cash register system 10, before in step 30 again the denomination of this note of value further supplied is determined.

In step S32 the control unit 18 compares the denomination of the further supplied note value with the remaining amount still due. If the result of this comparison is that the denomination is smaller than the remaining amount due, the process continues with determination of the new remaining amount in step S24 wherein the denomination of the further supplied note of value is subtracted from the remaining amount which had to be paid previously. Accordingly, further notes of values are accepted as long as the comparison of the denomination with the remaining amount due in step S32 results in that the denomination of the note of value supplied last is higher than the remaining amount still due. In this case the control unit in step S34 compares the denomination of the note of value last supplied with the fixed maximum amount. If the result of this comparison is that the denomination is lower than the maximum amount, the control unit in step S39 calculates the change to be given to the operator via the output unit 20 by subtracting the remaining amount due from the denomination, and controls the storage units 24 so that the change is given to the operator. Then the process is ended in step S40.

If, however, the result of the comparison of the denomination of the note of value last supplied with the maximum amount in step S34 is that the denomination is higher than the maximum amount, the note of value supplied last is not accepted. In this case the control unit 18 controls the monitor 14 in particular so that the monitor displays information to be person operating the cash register system 10 by means of which the person is informed that the note of value supplied is not accepted. In particular, the operator is informed by the monitor 14 of which denominations notes of value are accepted for payment of the remaining amount. Further, the operator is asked to supply a note of value of a corresponding denomination.

After a new note of value has been supplied in step S38 the process is continued in step S30 where the denomination of the note of value is determined.

If in step 22 the result of the comparison of the note of value supplied first with the total amount due already was that the denomination of the note of value supplied first is higher than the amount due, the denomination of this note of value is in step S42 compared with the maximum amount fixed at the beginning in step S16. If the result of the comparison is that the denomination is smaller than the maximum amount the process is continued in step S39 where the change is calculated and dispensed before the process is ended in step S40.

If, however, in step S42 the result of the comparison of the denomination of the note of value first supplied with the maximum amount fixed at the beginning is that the denomination is higher than the maximum amount, then in step S44, in analogy to step S36, the note of value is returned to the operator via the output unit 20, and the operator is asked to supply a note of value of an accepted denomination. In particular, instead of the accepted denomination the valid maximum amount can be displayed.

After the operator has supplied a new note of value in step S46 the process is continued in step S20 where the denomination of the newly supplied note of value is determined.

Via the above described process, in particular via fixing the maximum amount in dependence of the total amount due or the remaining amount still due, respectively, it is achieved that the amount of money maximally to be dispensed is limited so that the change available in the automatic cash register system 10 is sufficient for a larger number of payment processes. In particular, the interval at which the automatic cash register system must be supplied with new notes of value can thus be extended.

Fixing the maximum amount in dependence of the amount of money due or the remaining amount due, respectively is effected in particular by multiplying the amount of money due or the remaining amount, respectively, by a preset factor.

Alternatively, the maximum amount can be determined so that a maximum amount is preset for each one of different predetermined ranges of the amount of money due or of the remaining amount, respectively. In this case, the control unit determines within which of these predetermined ranges the amount of money due or the remaining amount, respectively, falls and fixes the maximum amount correspondingly.

Further, there is the possibility to determine the maximum amount via more complicated predetermined algorithms than the simple multiplication by a preset factor.

Alternatively, it is further possible that the control unit 18 fixes the maximum amount not only in dependence of the amount of money due, or the remaining amount due, respectively, but additionally also in dependence of the stock of the individual denominations in the cash register system. For this purpose, the control unit 18 determines by means of corresponding sensors in particular the stock of notes of value of at least one storing unit 24. In particular, the control unit 18 determines the current stock for each of the denominations and fixes the maximum amount in dependence of the determined stock.

Alternatively, determination of the stock might not be effected by means of sensors but the current stock of notes of value can be stored in the memory element of the control unit 18 and can be updated respectively by subtracting the notes of value dispensed and adding the notes of value supplied.

By taking into account the stock of notes of value of the individual denominations in fixing the maximum amount, dispensing of change can be controlled more accurately because, for example, in particular a lower maximum amount is set if only few notes of value are left of one denomination or more denominations than if a plurality of notes of value of this denomination were still available, so that the number of possible payment processes is increased without supplying new notes of value.

Figure 3:
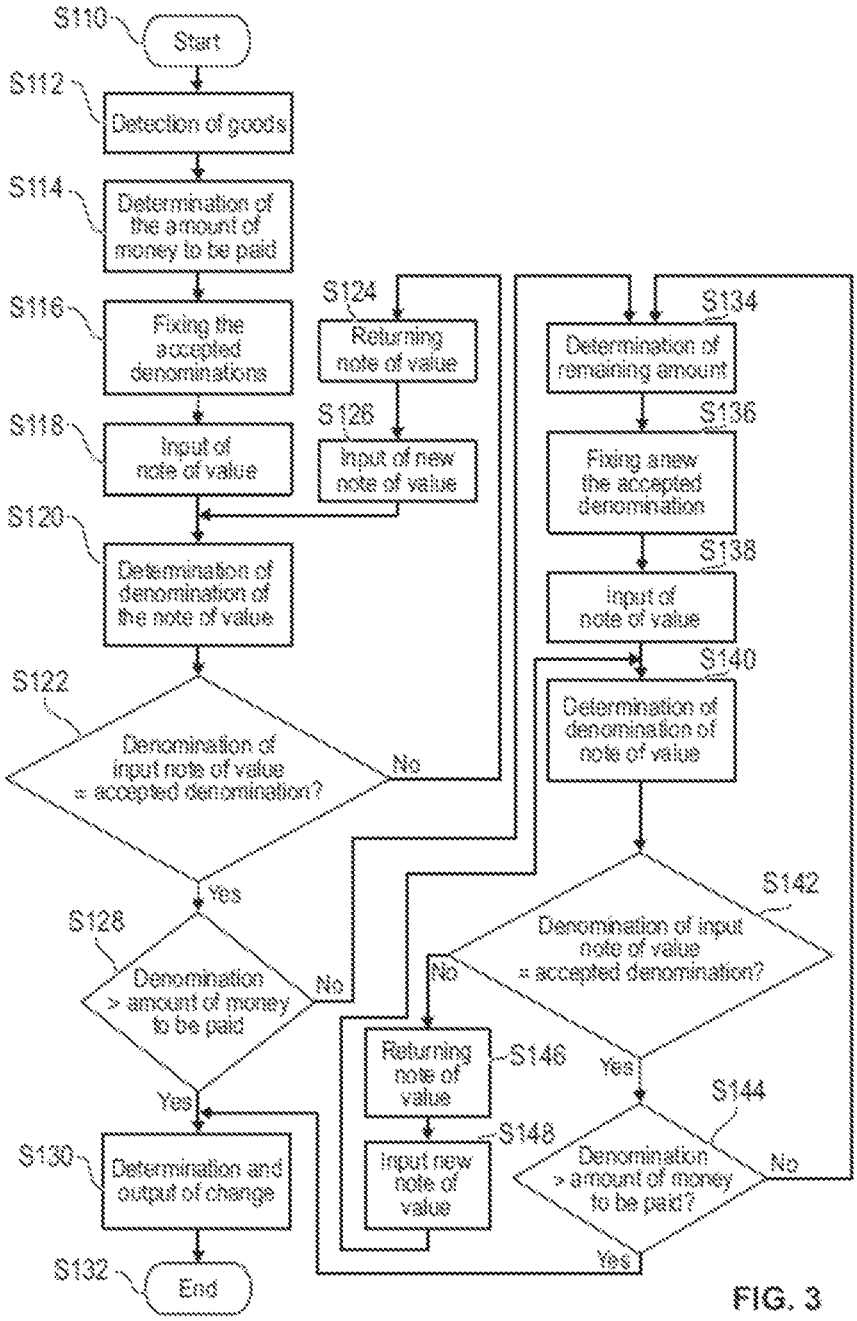
FIG. 3 is a flow chart of a process for paying for selected good according to a second embodiment.

FIG. 3 shows a flow chart for paying for goods according to a second embodiment. After the process has started in step S110, the goods are detected in step S112 via the detecting unit 112; subsequently the amount due for payment of the detected goods is determined by the control unit 18 in step S114 and is displayed via the monitor 14.

Then, the control unit 18 fixes in step S116 which denominations may be supplied for payment of the amount due, i.e. which denominations are accepted.

Subsequently, a note of value is supplied by the operator via the input unit 16 in step S118, before the sensor unit 22 in step S120 determines the denomination of the supplied note of value.

In step S122 the control unit 18 compares the denomination of the note of value supplied in step S118 with the denominations fixed as the accepted denominations in step S116. If the result of this comparison is that the denomination of the supplied note of value does not correspond to one of the accepted denominations, the note of value is returned to the operator via the output unit 20 in step S124. In particular a display is shown on the monitor 14 containing information that the note of value was not accepted. Further, in particular information is displayed showing of which denominations notes of value are accepted. In addition, the operator may be asked via the monitor 14 to supply a new note of value of a corresponding denomination.

After a further note of value has been supplied in step S126, the process is continued again with step S120, i.e. with the determination of the denomination of the note of value newly supplied.

If, however, in step S122 the result of the comparison of the note of value inserted with the accepted denominations was that the denomination of the supplied note of value is one of the accepted denominations, the control unit 18 in step S128 compares this denomination with the amount of money due. If the result of this comparison is that the denomination is higher than the amount of money due, the process is continued in step S130 where the control unit 18 determines an amount of change to be dispensed via the output unit 20 by in particular subtracting the amount of money due from the denomination of the note of value. Further, the control unit 18 controls the storing units 24 so that the notes of value required for dispensing the change are removed from the storing units 24 correspondingly, and are transported to the output compartment 20. Subsequently, the process is ended in step S132.

If, however, the result of the comparison of the supplied note of value with the amount of money due in step S128 was that the denomination is smaller than the amount of money due, so that this note of value does not suffice for settling the amount of money due, the process is continued in step S134 where the control unit 18 calculates the remaining amount still due. For this purpose, the control unit 18 subtracts the denomination of the note of value supplied last from the amount of money due.

In step S136 the control unit 18 fixes the denominations of which notes of value are accepted for payment of the remaining amount calculated in step S134.

Then, in step S138 a further note of value is supplied by the person operating the automatic cash register system 10, and the denomination thereof is determined in step S140 by means of the sensor unit 22.

Afterwards, the control unit 18 determines in step S142 whether the denomination of the note of value supplied in step S138 corresponds to one of the denominations fixed as the accepted denominations in step S136. If this applies, the denomination of this last supplied note of value is compared with the remaining amount still due in step S144. If the result of this comparison is that the denomination is smaller than the amount of money due, the process is continued in step S124 where the remaining amount due is calculated again.

If, however, the result of the comparison is that the denomination is higher than the amount still due, the process is continued in step S130 with calculation of the change to be dispensed before the process is subsequently ended in step S132 after the change has been dispensed.

If, however, in step S142 the result of the comparison of the denomination of the note of value supplied in step S138 with the denominations fixed as the accepted denominations was that the note of value does not have one of the accepted denominations, the note of value is returned in step S146, in analogy to what has been described in connection with step S124. After the operator has supplied a new note of value in step S148 the process is continued in step S140 with determination of the denomination of this note of value.

Fixing of the accepted denominations in steps S116 and S136 in particular is effected in dependence of a current operating parameter of the cash register system 10. Thereby it is achieved that acceptance of the denominations is adaptable to a respective current operating state, so that by correspondingly adapting the accepted notes of value the number of possible payment processes and the interval at which the cash register system 10 must be supplied with new notes of value can be increased.

In particular, the amount of money previously due or, for defining the denominations in step S136, the previously calculated remaining amount still due, respectively, is used as operating parameter. In particular, a preset algorithm is stored in the control unit 18 by means of which the control unit 18 fixes the accepted denominations in dependence of the amount due or the remaining amount still due, respectively.

Alternatively, for each possible amount due or each remaining amount still due, respectively, it can be stored in the control unit 18 with unambiguous assignment, which denominations are to be accepted.

Here, the respective accepted denominations are in particular defined so that the higher the amounts due or the remaining amounts due, respectively, are, the higher are the denominations whereof notes of value are accepted. Thereby it is achieved that, on the one hand, as few notes of value as possible are dispensed for giving the change, and on the other hand, that the customer, too, must use as few notes of value as possible to settle the amount of money due. Thereby, user-friendliness is increased on the one hand, while on the other hand it is prevented that, due to supply of a great number of small-denomination notes value for payment of a large amount of money, a large number of notes of value is supplied so that the storing units 24 would reach their maximum storage capacity relatively soon and consequently emptying of the storing units 24 would be necessary.

Determination of the accepted denominations in step S116 in dependence of the amount of money due and determination of the accepted denominations in step S136 in dependence of the remaining amount still due is in particular effected according to the same criteria.

Further, it is alternatively possible that the accepted denominations are fixed only once in step S116 after determination of the amount of money due in dependence thereof, and that the denominations are maintained also for payment of the remaining amount determined in step S134. In this case step S136 is omitted.

Further also other current operational parameters can additionally or alternatively be used for fixing the accepted denominations. In particular the accepted denominations can be fixed in dependence of the current stock of notes of value in the storing units 24. For this purpose, the control unit 18 in particular determines each current stock, for example via a sensor and/or on the basis of stored data.

In particular an algorithm is stored in the control unit 18 by means of which the control unit 18 calculates the accepted denominations in dependence of the current stocks. Alternatively, for each possible stock or any combination of stocks of notes of value of different denominations of the individual storing units 24, it can be stored with unambiguous assignment in a memory element of the control unit 18, which combinations are accepted.

Further, it is alternatively possible that in the process according to the FIG. 3, after supply of a note of value and determination of the denomination, it is first checked whether the denomination of this note of value is higher than the amount of money due or the remaining amount still due, respectively. In this case, the accepted denominations are in particular fixed so that at least all denominations which are smaller than the amount of money due or the remaining amount still due, respectively, are accepted in any case. As a consequence, if the denomination is smaller than the amount of money currently due, this note of value is already accepted in any case so that in this case checking whether the denomination is one of the accepted denominations can be omitted. Thus in this embodiment a comparison of the denomination of the supplied note of value with the accepted denominations is required only if the denomination is higher than the amount of money due or the remaining amount due, respectively.

In a further alternative embodiment of the invention the two embodiments described in connection with FIGS. 2 and 3 can be combined, i.e. that the control unit 18 fixes both, a maximum amount as well as the accepted denominations. In particular, fixing of both, the maximum amount as well as the accepted denominations is effected anew after supply of each note of value.

Further, in the process according to the second embodiment described in connection with FIG. 3, it is also possible that all notes of value by means of which the operating person intends to settle the amount of money due are supplied to the input unit 16 simultaneously as a bundle of notes of value. In this case, after separation of the supplied notes of value in particular the denominations of all the supplied notes of value are determined and each one is compared with the accepted denominations.

The control unit 18 can in particular be a control unit of the cash register system 10 via which the complete cash register system 10 is controlled. Alternatively, the control unit 18 which fixes the accepted denominations and/or the maximum value can be a control unit of the detecting unit 12. This applies in particular if the automatic cash register system 10 is designed to have a modular structure.

In a further alternative embodiment it is also possible that the supply of notes of value for payment of the selected goods is already possible when not all goods have been detected via the detecting unit 12 yet. In this case the control unit 18 fixes the maximum amount and/or the accepted denominations in dependence of the amount currently still due.

Further, the current operating parameter for fixing the accepted denominations and/or fixing the maximum amount can also be a status of the person operating the automatic cash register system 10. For this purpose, the operator must in particular identify himself/herself for example by inserting a magnetic stripe card and/or a chip card. On the chip or on the magnetic stripe, respectively, in particular the status of the operating person is stored. For example, operating persons which often shop at the owner of the automatic cash register system 10 can be stored as preferred customers with a preferred status, wherein the control unit 18 for such preferred customers controls the automatic cash register system 10 so that notes of value of all denominations are accepted.

When payment is effected while not all goods have been detected yet, an allowable maximum amount and/or the accepted denominations can be fixedly preset, wherein this maximum amount defines which amount can maximally be supplied when payment is made as long as not all the goods have been detected, or wherein the accepted denominations define which denominations are accepted in this case during detection of the goods.

After all the goods have been detected a respective input is made by the operating person, for example by touching a corresponding display surface of the monitor 14 formed as a touch screen, whereupon the control unit 18 newly fixes the maximum amount and/or the accepted denominations, in particular according to the processes described in connection with FIGS. 2 and 3.

Further it is advantageous if each time a note of value was not accepted because this maximum value was exceeded and/or because it was a note of value of a denomination not accepted, information thereon is stored in a memory element of the control unit 18 so that the history of the payment process can be reconstructed any time.

What is claimed is:

1. An automatic cash register system, comprising:
- a detection unit for detecting goods to be paid for;
- a control unit which determines an amount of money due;
- an input unit for supplying notes of value for paying the amount of money due;
- a sensor unit for determining denominations of the notes of value supplied; and
- an output unit for dispensing change;
- wherein the control unit, as a function of the amount of money due, fixes which denominations are accepted for payment of the amount of money due by multiplying the amount of money due by a predetermined factor.

2. The automatic cash register system according to claim 1, wherein, for at least one denomination, a threshold value is stored in the control unit, that the control unit compares the amount of money due with the threshold value, and that the control unit controls the cash register system so that a note of value of this denomination is accepted only if the amount due is smaller than the threshold value.

3. The automatic cash register system according to claim 2, wherein, for each one of a plurality of denominations of a preset currency set a respective threshold value is preset, in dependence of which the control unit fixes whether the corresponding denomination is accepted.

4. The automatic cash register system according to claim 1 wherein, for at least one preset denomination, the control unit determines the current stock of notes of value of this denomination in the cash register system, and that the control unit in dependence of the current stock fixes of which denominations notes of value are accepted.

5. The automatic cash register system according to claim 4, wherein for all the denominations of a preset currency set, the control unit determines the current stock of notes of value of the respective denomination in the cash register system, and that the control unit in dependence of the current stocks fixes of which denominations notes of value are accepted.

6. The automatic cash register system according to claim 5, wherein, for at least one denomination, information is stored in the control unit that notes of value of this denomination are not accepted.

7. The automatic cash register system according to claim 1 wherein the control unit, after supply of a note of value for payment of the amount of money due, determines the value of this note of value, wherein the control unit then calculates a remaining amount still due if the value of the note of value is smaller than the amount of money due, and that the control unit in dependence of at least one current operating parameter newly fixes which denominations are accepted for payment of the remaining amount.

8. The automatic cash register system according to claim 7, wherein the control unit, in dependence of the remaining amount, fixes which denominations are accepted.

9. The automatic cash register system according to claim 1 wherein the control unit fixes a maximum amount in dependence of the amount of money due, and that the control unit controls the cash register system so that in the payment of the amount of money due only notes of value or combinations of notes of value are accepted whose value does not exceed the maximum amount.

10. An automatic cash register system, comprising:
- a detection unit for detecting goods to be paid for;
- a control unit which determines an amount of money due;
- an input unit for supplying notes of value for paying the amount of money due;
- a sensor unit for determining the denomination of the notes of value supplied; and
- an output unit for dispensing change;
- wherein the control unit determines a maximum amount depending on the amount of money due; and
- wherein the control unit controls the cash register system so that in the payment of the amount of money due only notes of value or combinations of notes of value are accepted whose value does not exceed the maximum amount.

11. The automatic cash register system according to claim 10, wherein the control unit determines the stock of notes of value of at least one determination, and that the control unit determines the maximum amount in dependence of this stock.

12. The automatic cash register system according to claim 10, wherein the control unit determines the maximum amount by multiplying the amount of money due by a predetermined factor.

13. The automatic cash register system according to claim 12, wherein the factor has a value between 1.1 and 3.

14. The automatic cash register system according to claim 10, wherein the control unit, after supply of a note of value for payment of the amount of money due, determines the value of this note of value, that the control unit calculates a remaining amount still due if the value of the note of value is smaller than the amount of money due, and that the control unit newly fixes the maximum amount in dependence of this remaining amount.

15. An automatic cash register system, comprising:
- a detection unit configured to detect one or more goods to be paid for;
- a control unit configured to determine an amount of money due for the one or more goods;
- an input unit configured to receive notes of value for paying the amount of money due;
- a sensor unit configured to identify denominations of the notes of value received by the input unit; and
- an output unit configured to dispense change;
- wherein the control unit is configured to:
  - set a maximum value of notes of value to be received by the input unit for paying the amount of money due by multiplying the amount of money due by a predetermined factor; and limit the notes of value or combinations of notes of value accepted by the input unit for payment of the amount of money due such that value thereof does not exceed the maximum value.

16. The automatic cash register system of claim 15, wherein the predetermined factor has a value between 1.1 and 3.

17. The automatic cash register system of claim 15, wherein the predetermined factor has a value between 1.5 and 2.

18. The automatic cash register system of claim 15, wherein the control unit is configured to determine a value of a note of value received for payment of the amount of money due, and calculate a remaining amount still due if the value of the note received is smaller than the amount of money due, and reset the maximum value depending on the remaining amount due.

19. The automatic cash register system of claim 15, wherein, for at least one preset denomination, the control unit is configured to determine a current stock of notes of value for the at least one preset denomination in the cash register system, and in dependence of the current stock set which denominations of notes of value will be accepted.

20. The automatic cash register system of claim 19, wherein for all the denominations of a preset currency set, the control unit is configured to determine the current stock of notes of value of the respective denomination in the cash register system, and set which denominations will be accepted based on the current stock.

* * * * *